United States Patent [19]

Colli

[11] 4,081,251

[45] Mar. 28, 1978

[54] PROCESS TO REMOVE IRON SULFIDE FROM COAL TO REDUCE POLLUTION

[75] Inventor: Albert J. Colli, Oxon Hill, Md.

[73] Assignee: The United States of America as represented by the Secretary of the Navy, Washington, D.C.

[21] Appl. No.: 728,709

[22] Filed: Oct. 1, 1976

Related U.S. Application Data

[63] Continuation-in-part of Ser. No. 702,839, Jul. 6, 1976, abandoned.

[51] Int. Cl.[2] ..... C10L 9/10

[52] U.S. Cl. ..... 44/1 R; 44/1 G

[58] Field of Search ..... 44/1 R, 1 A, 1 C, 1 G, 44/24; 75/6

[56] References Cited

U.S. PATENT DOCUMENTS

| | | | |
|---|---|---|---|
| 1,420,164 | 6/1922 | Trent | 44/1 A |
| 3,160,496 | 12/1964 | Vaccari et al. | 75/6 X |
| 3,938,966 | 2/1976 | Kindig et al. | 44/1 R |

*Primary Examiner*—Carl F. Dees

*Attorney, Agent, or Firm*—R. S. Sciascia; A. L. Branning; H. B. Field

[57] ABSTRACT

A method for reducing the amount of sulfur present in coal which comprises grinding the coal to less than 100 microns, physically separating the fine coal rich fraction from the coarse pyrite rich coal fraction, diluting the coarse pyrite rich coal fraction with a liquid hydrocarbon carrier and then separating the high pyrite coal from the low coarse pyrite coal by passing the particles through a magnetic separator.

12 Claims, 1 Drawing Figure

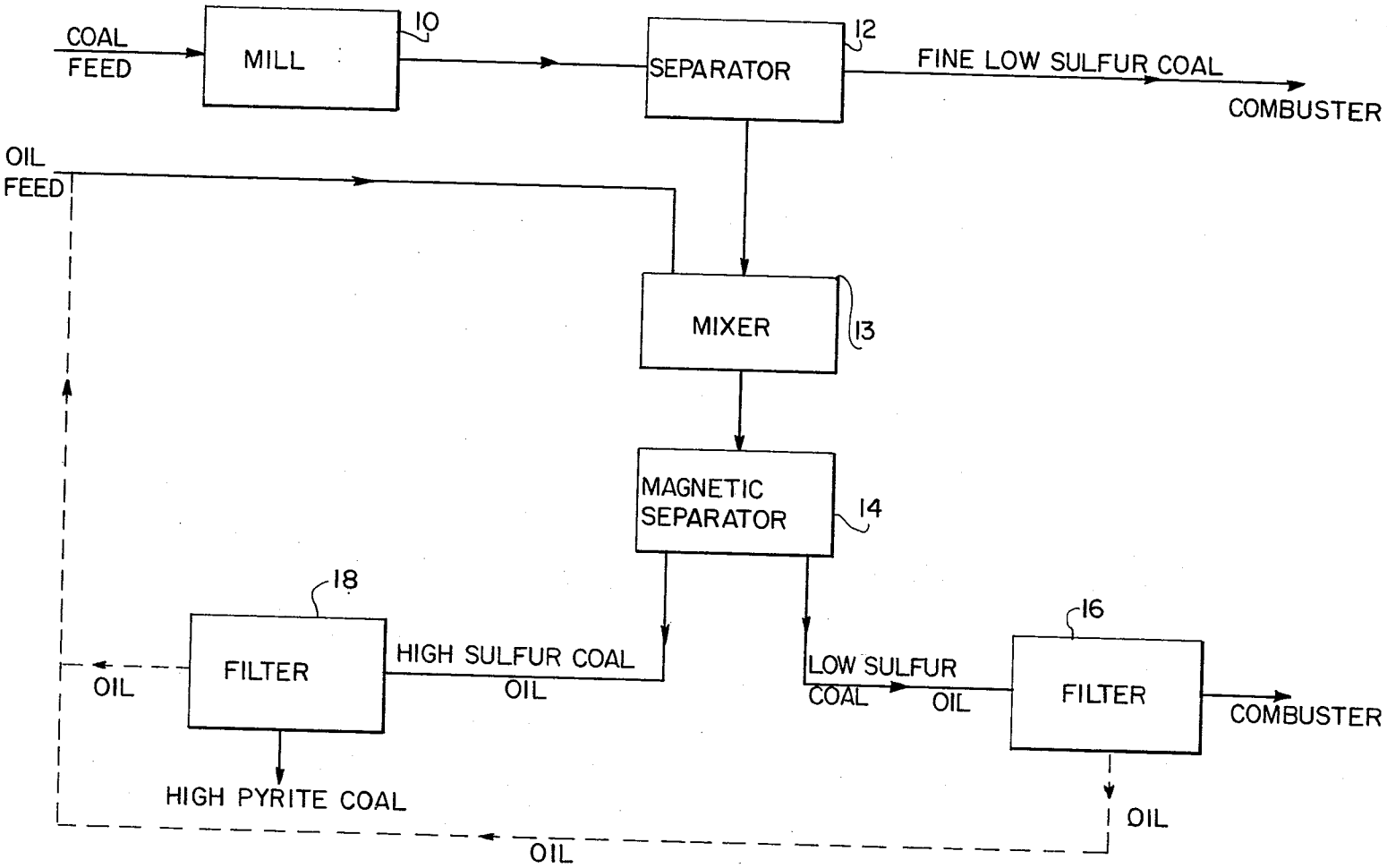
COAL FEED
MILL
10
SEPARATOR
12
FINE LOW SULFUR COAL
COMBUSTER
OIL FEED
MIXER
13
MAGNETIC SEPARATOR
14
LOW SULFUR COAL
OIL
FILTER
16
COMBUSTER
OIL
HIGH SULFUR COAL
OIL
FILTER
18
OIL
HIGH PYRITE COAL
OIL

PROCESS TO REMOVE IRON SULFIDE FROM COAL TO REDUCE POLLUTION

BACKGROUND OF THE INVENTION

This Application is a continuation-in-part of copending application 702,839, filed July 6, 1976 and now abandoned.

The present invention relates to pollution control and more specifically to a method of reducing the level of sulfur dioxide generated during the combustion of high sulfur coal.

It is estimated that about 85% of the coal reserves east of the Mississippi River contain sulfur levels greater than one percent. Recent pollution abatement laws have prevented the combustion of this high sulfur coal unless the stack gases generated during the combustion process are controlled. To accomplish this, the processes of limestone scrubbing, sodium-base scrubbing, magnesium scrubbing, and catalytic oxidation have been developed and are currently in limited use. However, the actual removal of sulfur dioxide from stack gases has proven to be a problematical, complex and expensive procedure which ultimately produces large quantities of difficult to dispose of sulfur bearing compounds. Due to this problematical tendency less than 0.5% of the power generated in the United States is associated with a stack gas treatment method and this leaves many power plants operating in violation of the law.

SUMMARY OF THE INVENTION

Accordingly, there is provided by this invention a method for mechanically reducing the amount of sulfur in coal. This process includes grinding the coal to a particle size of less than 100 microns in diameter, separating the particles into a fine coal rich fraction and a cross pyrite rich fraction, diluting the coarse pyrite rich fraction with a liquid hydrocarbon carrier and magneticly filtering the dilute mixture so as to separate the dilute, coarse, coal rich particles from the dilute, coarse, pyrite rich particles.

OBJECTS OF THE INVENTION

Therefore, it is an object of the present invention to provide a mechanical means for removing sulfur from coal.

It is a further object of the present invention to provide a low cost method for removing sulfur from coal.

Still a further object of the present invention is to provide a reliable method for removing sulfur from coal.

Yet another object of the present invention is to provide a method wherein large quantities of treatment chemicals needed to treat stack gases are reduced.

BRIEF DESCRIPTION OF THE DRAWING

Other objects and many of the attendant advantages of this invention will be readily appreciated as the same becomes better understood by reference to the following detailed description when considered in connection with the accompanying drawing, wherein:

The FIGURE is a schematic representation of the process for the removal of iron sulfide from coal.

DESCRIPTION OF THE PREFERRED EMBODIMENTS

A high percentage of the sulfur in the bituminous coal mined in the Eastern United States is in the form of iron sulfide (pyrite). This compound has been found to be more dense, less friable and to contain certain magnetic properties which permits its mechanical separation from coal. To accomplish this separation, the coal must be ground to less than 100 microns in diameter. However, once ground, intra particle forces cause particle agglomeration and prevent efficient physical separation of the pyrite from coal.

In accordance with the present invention, separation is effected by feeding coal into a grinder 10, such as fluid energy mill, where it ground to less than 100 microns in diameter. Although the 100 micron particle size is adequate, separation of the pyrite and coal is more easily accomplished if the coal is ground to less than 70 microns in diameter. Once ground to the desired particle size, the coal/pyrite particles are conveyed by any conventional means to a separator 12, such as high efficiency centrifugal classifier. There, the fine coal rich fraction is separated from the coarse pyrite rich fraction of the coal by adjusting the separator to a predetermined particle size cut-off point. Depending on the particular coal composition, grinder, and separator, the particle size cut-off point for separating fines from coarse may be as low as 3 microns to as high as 50 microns, however, a cut-off point lying between 3 and 30 microns is preferred and a cut-off point of 6 microns is most preferred.

After passing through the separator 12, the low sulfur fines are conveyed to a combustor. The coarse fraction of the coal which contains the high percentage of the pyrite is further treated by diluting it in a mixer 13 with a liquid hydrocarbon carrier. The liquid hydrocarbon acts not only as a carrier, but reduces the interfering intraparticle forces and thereby aids in separation. The total weight percent of coal in the liquid hydrocarbon carrier may vary from as low as 5 percent to as much as 20 percent although a range from 10 to 18 percent is preferred and 15 percent is most preferred. Virtually any liquid hydrocarbon may be used as the carrier, including those of Number 2, Number 3, Number 4, Number 5, and Number 6 fuel oil, kerosene and gasoline however, Number 2, Number 3 and Number 4 fuel oil, and kerosene are preferred, and Number 2 fuel oil is most preferred because it is economical and readily available.

Once the coarse pyrite rich coal fraction is thoroughly admixed with the liquid hydrocarbon carrier it is conveyed to a magnetic separator 14 where the magnetic properties of the pyrite permit it to be separated from the non magnetic coarse coal particles.

It should be noted that the final separation of the sulfur from coal is accomplished once the particles have been passed through the magnetic separator 14. However, to prepare the wet coal for combustion the wet coarse particles are first passed through a filter 16 where excess liquid is removed and recycled. Concurrently, the coarse pyrite rich coarse coal fraction is filtered through filter 18 to remove and recycle the liquid while the wet high pyrite coal is removed from the system as a byproduct.

Although this process will remove sufficient sulfur from the coal to either eliminate or reduce the need for further treatment of stack gases for sulfur dioxide, it is not necessarily meant to be the sole means to reduce pollutants from the stack gases, Rather, it is also possible to use this process to supplement other systems in the attempt to control sulfur dioxide stack gases. By combining a conventional system with the process of the present invention, the amount of chemicals needed for treating sulfur dioxide would be reduced as well as the ultimate quantity of sulfur bearing compounds.

Thus it is apparent that there is provided by this invention a means for reducing the amount of sulfur in coal.

It is to be understood that what has been described is merely illustrative of the principles of the invention and that numerous arrangements in accordance with this invention may be devised by one skilled in the art without departing from the spirit and scope thereof.

What is claimed as new and desired to be secured by Letters Patent of the United States is:

1. A method of physically reducing the amount of sulfur in coal, which comprises the steps of:
   - grinding the coal to a particle size of less than 100 microns in diameter;
   - selecting a particle size cut off point which lies between 3 and 50 microns in diameter;
   - spearating said particles at the particle size cut off point into a fine coal rich fraction and a first course pyrite rich fraction;
   - diluting said first coarse pyrite rich fraction with a liquid hydrocarbon carrier to decrease intraparticle forces and help prevent agglomerations; and
   - passing said dilute coarse pyrite rich fraction through a magnetic separator, so as to separate the dilute coarse pyrite rich fraction into a second coarse pyrite rich fraction and dilute coarse coal rich fraction.

2. The method of claim 1 wherein said grinding is accomplished in a fluid energy mill.

3. The method of claim 1 wherein said coal is ground to a particle size of less than 70 microns in diameter.

4. The method of claim 1 wherein said particle size cut-off point lies between 3 and 30 microns in diameter.

5. The method of claim 4 wherein said particle size cut-off point is 6 microns in diameter.

6. The method of claim 1 wherein said separator is a high efficiency centrifugal classifier.

7. The method of claim 1 wherein said liquid hydrocarbon carrier is selected from a group consisting of Number 2, Number 3, Number 4, Number 5 and Number 6 fuel oil, kerosene and gasoline.

8. The method of claim 6 wherein said lqiuid hydrocarbon carrier is selected from the group consisting of Number 2, Number 3, and Number 4 fuel oil, and kerosene.

9. The method of claim 7 wherein said liquid hydrocarbon carrier is Number 2 fuel oil.

10. The method of claim 1 wherein said first coarse pyrite rich fraction is from 5 to 20 total weight percent of said dilute coarse pyrite rich fraction.

11. The method of claim 10 wherein said first coarse pyrite rich fraction is from 10 to 18 total weight percent of said dilute coarse pyrite rich fraction.

12. The method of claim 11 wherein said first coarse pyrite rich fraction is 15 total weight percent of said dilute coarse pyrite rich fraction.

* * * * *